US011365913B2

(12) United States Patent
Xu et al.

(10) Patent No.: US 11,365,913 B2
(45) Date of Patent: Jun. 21, 2022

(54) EJECTOR REFRIGERATION SYSTEM AND CONTROL METHOD THEREOF

(71) Applicant: Carrier Corporation, Farmington, CT (US)

(72) Inventors: Jiaoquan Xu, Shanghai (CN); Qianli Fu, Shanghai (CN); Hongsheng Liu, Shanghai (CN); Parmesh Verma, South Windsor, CT (US)

(73) Assignee: CARRIER CORPORATION, Palm Beach Gardens, FL (US)

( * ) Notice: Subject to any disclaimer, the term of this patent is extended or adjusted under 35 U.S.C. 154(b) by 329 days.

(21) Appl. No.: 16/468,576

(22) PCT Filed: Dec. 14, 2017

(86) PCT No.: PCT/US2017/066264
§ 371 (c)(1),
(2) Date: Jun. 11, 2019

(87) PCT Pub. No.: WO2018/118609
PCT Pub. Date: Jun. 28, 2018

(65) Prior Publication Data

US 2021/0302077 A1 Sep. 30, 2021

(30) Foreign Application Priority Data

Dec. 21, 2016 (CN) ..... 201611189521.1

(51) Int. Cl.
*F25B 41/20* (2021.01)
*F25B 5/02* (2006.01)
(Continued)

(52) U.S. Cl.
CPC ..... *F25B 41/20* (2021.01); *F25B 5/02* (2013.01); *F25B 5/04* (2013.01); *F25B 49/022* (2013.01);
(Continued)

(58) Field of Classification Search
CPC .. F25B 41/20; F25B 41/31; F25B 5/02; F25B 5/04; F25B 49/022; F25B 2341/0012;
(Continued)

(56) References Cited

U.S. PATENT DOCUMENTS 3,602,295 A 8/1971 Klaas
4,018,583 A 4/1977 Patnode et al.
(Continued)

FOREIGN PATENT DOCUMENTS

BR 0204072 A 9/2003
CN 1475716 A 2/2004
(Continued)

OTHER PUBLICATIONS

C. Pollerberg, et al., "Experimental Study on the Performance of a Solar Driven Steam Jet Ejector Chiller," Energy Conversion and Management, 49, 2008, pp. 33-18-3325.
(Continued)

*Primary Examiner* — Miguel A Diaz
(74) *Attorney, Agent, or Firm* — Cantor Colburn LLP

(57) ABSTRACT

An ejector refrigeration system, comprising: a compressor, a heat-extraction heat exchanger, an ejector, a separator, a first throttling element, and a heat-absorption heat exchanger that are connected through pipelines, the ejector having a main flow inlet connected to the heat-extraction heat exchanger, and further having a secondary flow inlet and an ejector outlet; the separator having a separator inlet connected to the ejector outlet, a separator liquid outlet connected to the first throttling element, and a separator gas outlet connected to a gas inlet of the compressor, wherein turn-on and turn-off of a first flow path connecting the heat-absorption heat exchanger and the secondary flow inlet of the ejector and a
(Continued)

second flow path connecting the heat-absorption heat exchanger and the gas inlet of the compressor are controllable.

14 Claims, 2 Drawing Sheets

(51) Int. Cl.
*F25B 5/04* (2006.01)
*F25B 49/02* (2006.01)

(52) U.S. Cl.
CPC ..... *F25B 2341/0012* (2013.01); *F25B 2400/0409* (2013.01); *F25B 2400/23* (2013.01)

(58) Field of Classification Search
CPC ..... F25B 2341/0013; F25B 2341/001; F25B 2341/00; F25B 2400/0409; F25B 2400/23; F25B 2400/0407; F25B 9/08; F25B 9/10
See application file for complete search history.

(56) References Cited

U.S. PATENT DOCUMENTS

| | | | | |
|---|---|---|---|---|
| 4,761,970 | A | 8/1988 | MacCracken | |
| 6,422,308 | B1 | 7/2002 | Okawara et al. | |
| 6,477,857 | B2 * | 11/2002 | Takeuchi | F25B 9/008 62/191 |
| 6,722,147 | B2 | 4/2004 | Heyl et al. | |
| 6,782,713 | B2 | 8/2004 | Takeuchi et al. | |
| 6,834,514 | B2 * | 12/2004 | Takeuchi | B60H 1/3204 62/170 |
| 6,837,069 | B2 | 1/2005 | Takeuchi et al. | |
| 6,857,286 | B2 | 2/2005 | Ohta et al. | |
| 6,901,765 | B2 | 6/2005 | Amaral et al. | |
| 7,207,186 | B2 * | 4/2007 | Hirota | F04F 5/04 62/228.3 |
| 8,156,754 | B2 | 4/2012 | Hong et al. | |
| 8,713,962 | B2 | 5/2014 | Okazaki | |
| 9,200,820 | B2 | 12/2015 | Okazaki et al. | |
| 9,217,590 | B2 | 12/2015 | Cogswell et al. | |
| 10,059,173 | B2 | 8/2018 | Lee et al. | |
| 10,094,577 | B2 | 10/2018 | Dennis | |
| 10,823,461 | B2 * | 11/2020 | Hellmann | F25B 1/10 |
| 2003/0066301 | A1 * | 4/2003 | Takeuchi | F25B 41/00 62/191 |
| 2004/0103685 | A1 * | 6/2004 | Yamaguchi | B60H 1/00899 62/500 |
| 2006/0254748 | A1 | 11/2006 | Watanabe et al. | |
| 2007/0163293 | A1 | 7/2007 | Ikegami et al. | |
| 2010/0000713 | A1 | 1/2010 | Takahashi et al. | |
| 2011/0289953 | A1 | 12/2011 | Alston | |
| 2012/0167601 | A1 * | 7/2012 | Cogswell | F25B 1/10 62/115 |
| 2013/0042640 | A1 * | 2/2013 | Higashiiue | F25B 41/00 62/196.1 |
| 2015/0176868 | A1 | 6/2015 | Kayano et al. | |
| 2016/0339766 | A1 | 11/2016 | Choi et al. | |
| 2017/0159977 | A1 * | 6/2017 | Hellmann | F25B 1/10 |
| 2017/0197490 | A1 | 7/2017 | Enomoto et al. | |
| 2017/0211850 | A1 * | 7/2017 | Fukushima | F25B 43/00 |
| 2018/0142927 | A1 * | 5/2018 | Hellmann | F25B 41/00 |
| 2019/0137192 | A1 | 5/2019 | Gil et al. | |
| 2020/0248932 | A1 | 8/2020 | Cogswell et al. | |
| 2020/0248938 | A1 | 8/2020 | Liu et al. | |

FOREIGN PATENT DOCUMENTS

| | | | |
|---|---|---|---|
| CN | 1687676 | A | 10/2005 |
| CN | 101097099 | A | 1/2008 |
| CN | 101158517 | A | 4/2008 |
| CN | 101403536 | A | 4/2009 |
| CN | 201885295 | U | 6/2011 |
| CN | 103148629 | A | 6/2013 |
| CN | 103282730 | A | 9/2013 |
| CN | 203857718 | U | 10/2014 |
| CN | 204115293 | U | 1/2015 |
| CN | 106052178 | A | 10/2016 |
| CN | 205843115 | U | 12/2016 |
| DE | 10061658 | A1 | 9/2001 |
| DE | 10158104 | A1 | 6/2003 |
| DE | 102006042788 | A1 | 3/2008 |
| DE | 112013003452 | T5 | 4/2015 |
| EP | 0149413 | A2 | 7/1985 |
| EP | 1882890 | A2 | 1/2008 |
| EP | 3385642 | A1 | 10/2018 |
| JP | S5730674 | U | 2/1982 |
| JP | 2003074992 | A | 3/2003 |
| JP | 2005076914 | A | 3/2005 |
| JP | 2005249315 | A | 9/2005 |
| JP | 2008116124 | A | 5/2008 |
| JP | 4396004 | B2 | 1/2010 |
| JP | 2015004460 | A | 1/2015 |
| JP | 5786481 | B2 | 9/2015 |
| WO | 2008034828 | A1 | 3/2008 |
| WO | 2009128271 | A1 | 10/2009 |
| WO | 2012092686 | A | 7/2012 |
| WO | 2013055391 | A1 | 4/2013 |
| WO | 2017192302 | A1 | 11/2017 |
| WO | 2018118609 | A1 | 6/2018 |

OTHER PUBLICATIONS

International Search Report and Search Report for application PCT/US2017/066264, dated Mar. 22, 2018, 11 pages.

Extended European Search Report; International Application No. 20155169.4-1008; International Filing Date: Feb. 3, 2020; dated Jun. 5, 2020; 127 pages.

Extended European Search Report; International Application No. 20155172.8-1008; International Filing Date: Feb. 3, 2020; dated Apr. 1, 2020; 7 pages.

International Preliminary Report on Patentability; International Application No. PCT/US2017/066264; International Filing Date: Dec. 14, 2017; dated Jun. 25, 2019; 8 pages.

Written Opinion; International Application No. PCT/US2017/066264; International Filing Date: Dec. 14, 2017; dated Mar. 22, 2018; 6 pages.

Chinese Office Action for Application No. 201611189521.1; dated Apr. 26, 2021; 8 Pages.

* cited by examiner

EJECTOR REFRIGERATION SYSTEM AND CONTROL METHOD THEREOF

TECHNICAL FIELD

The present invention relates to the field of ejector refrigeration systems, and more particularly, to an ejector refrigeration system and a control method for the same.

BACKGROUND ART

At present, in the fields of heat supply, ventilation, and air conditioning or the refrigeration field, ejectors have been gradually used as a new refrigeration manner. The ejector refrigeration is advantageous in a more power-saving and more environment-friendly operation performance in an area having a higher ambient temperature. Therefore, an ejector refrigeration system generally has at least two modes, that is, a standard mode and an ejector mode, and it applies the ejector mode in a high-temperature operating condition, and applies the standard mode in a general or lower-ambient-temperature operating condition.

The ejector refrigeration system may face two types of problems. Firstly, when mode switching is conducted between the ejector mode and the standard mode, a pressure difference generated at two sides of a throttling element changes greatly in the two modes. For example, in the ejector mode, the pressure difference between two sides of a first throttling element may be 0.5 bar-1 bar, and in the standard mode, the pressure difference between two sides of the first throttling element may be 15-20 bar. Currently, it is difficult to select a model of the first throttling element which can operate while crossing two pressure difference intervals so far away from each other. Secondly, in such conventional ejector refrigeration system, in order to turn on/off the ejector in different operating modes, it is necessary to adopt multiple solenoid valves or three-way valves to implement control over on/off or switching of flow paths; this causes extremely complex control logic, thus reducing the reliability of the whole system.

SUMMARY OF THE INVENTION

An objective of the present invention is to provide an ejector refrigeration system that facilitates switching between operating modes.

Another objective of the present invention is to provide a control method for an ejector refrigeration system that facilitates switching between operating modes.

To implement the objectives of the present invention, according to one aspect of the present invention, an ejector refrigeration system is provided, including: a compressor, a heat-extraction heat exchanger, an ejector, a separator, a first throttling element, and a heat-absorption heat exchanger that are connected through pipelines, the ejector having a main flow inlet connected to the heat-extraction heat exchanger, and further having a secondary flow inlet and an ejector outlet; the separator having a separator inlet connected to the ejector outlet, a separator liquid outlet connected to the first throttling element, and a separator gas outlet connected to a gas inlet of the compressor, where turn-on and turn-off of a first flow path connecting the heat-absorption heat exchanger and the secondary flow inlet of the ejector and a second flow path connecting the heat-absorption heat exchanger and the gas inlet of the compressor are controllable.

According to another aspect of the present invention, a control method for an ejector refrigeration system is further provided, the system including a compressor, a heat-extraction heat exchanger, an ejector, a separator, a first throttling element, and a heat-absorption heat exchanger that are connected through pipelines, a first flow path connecting the heat-absorption heat exchanger and the ejector, and a second flow path connecting the heat-absorption heat exchanger and the compressor; the method includes: turning on the first flow path and turning off the second flow path in an ejector mode, where at this point, a passage connecting from the heat-absorption heat exchanger to a secondary flow inlet of the ejector is turned on, and a passage connecting from the heat-absorption heat exchanger to an intake port of the compressor is turned off; and/or turning on the second flow path and turning off the first flow path in a standard mode, where at this point, the passage connecting from the heat-absorption heat exchanger to the intake port of the compressor is turned on, and the passage connecting from the heat-absorption heat exchanger to the secondary flow inlet of the ejector is turned off.

DETAILED DESCRIPTION

Figure 1:
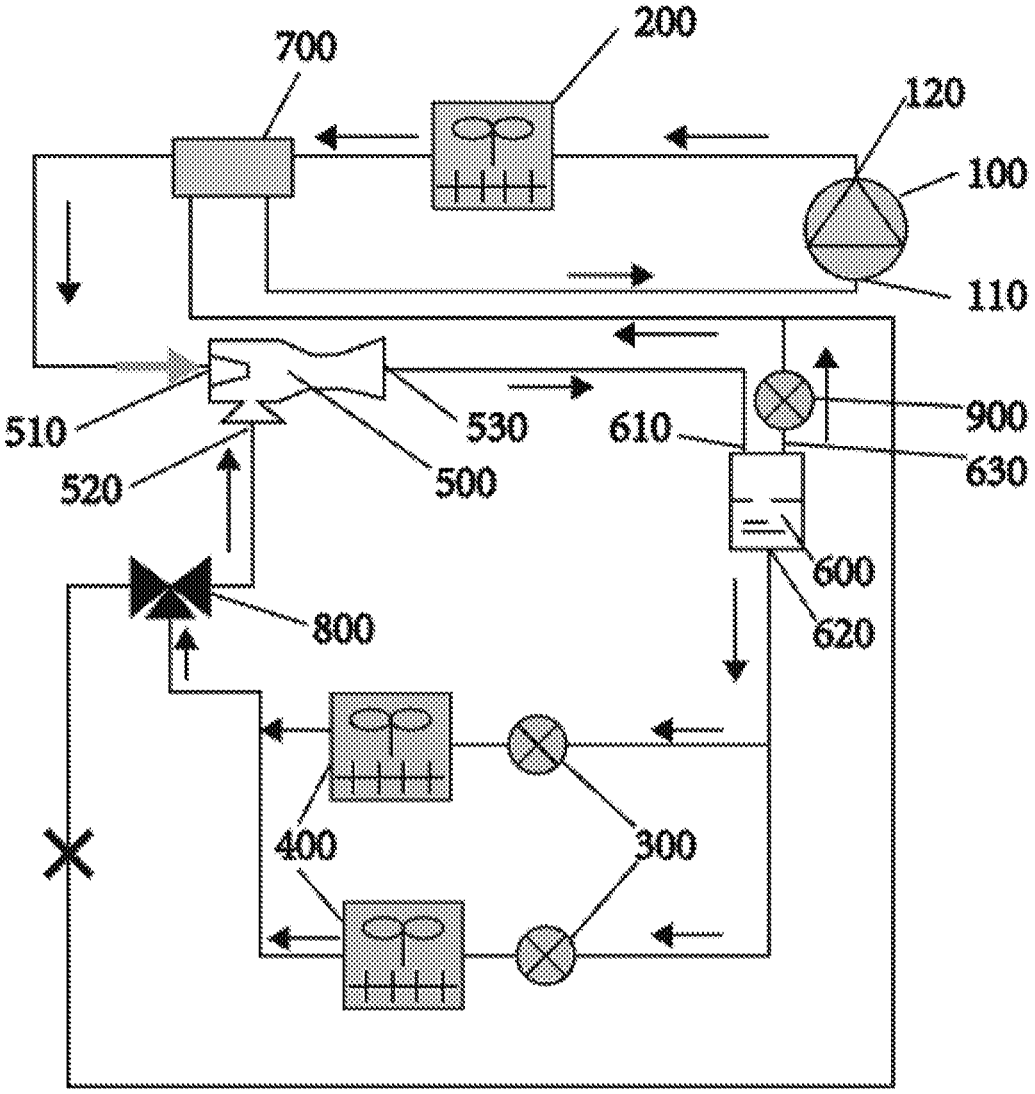
FIG. 1 is a schematic diagram of an operating state of an ejector refrigeration system in an ejector mode according to an embodiment of the present invention.
Figure 2:
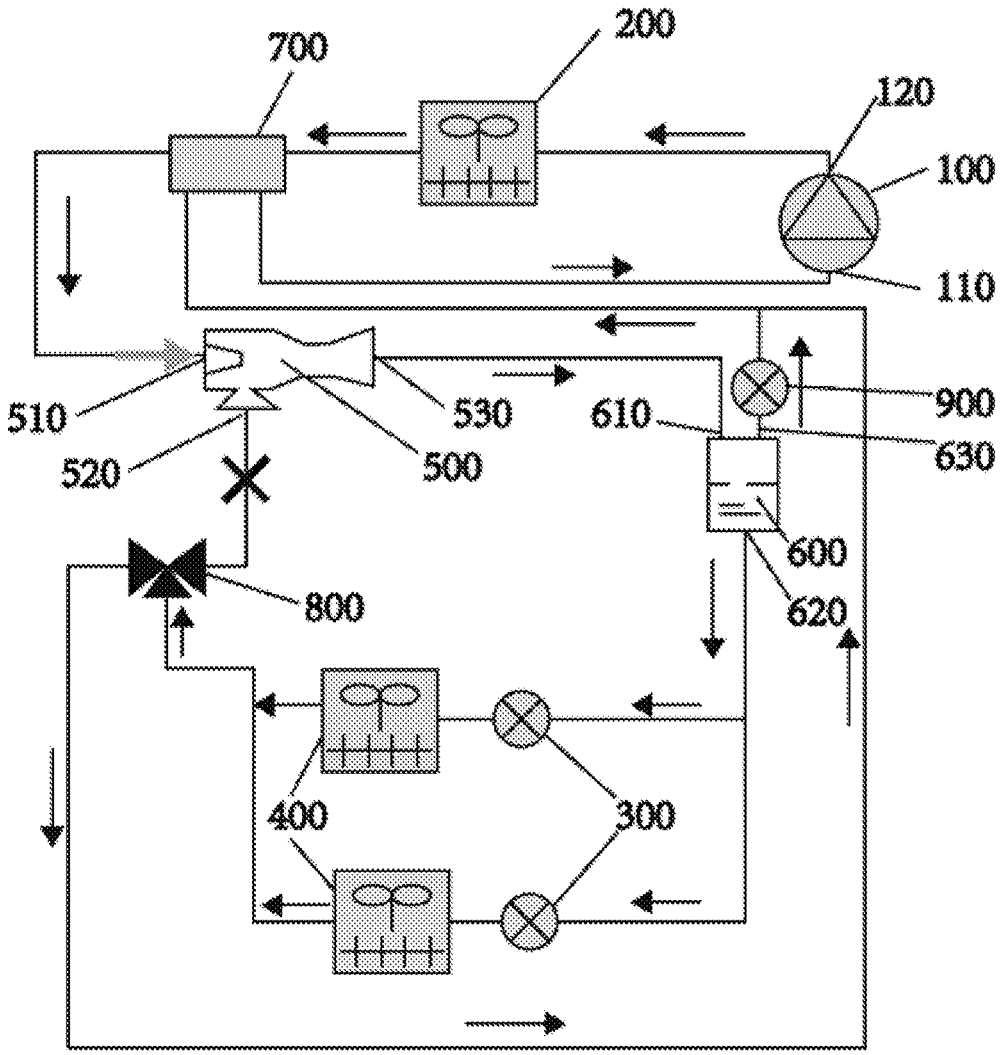
FIG. 2 is a schematic diagram of an operating state of the ejector refrigeration system in a standard mode according to an embodiment of the present invention.

Referring to FIG. 1 and FIG. 2, an embodiment of an ejector refrigeration system is shown. The two drawings show flow path on/off control conditions of the same system in different operating modes, respectively. First of all, a structure of the ejector refrigeration system will be understood in the following with reference to the accompanying drawings.

As shown in the drawings, the ejector refrigeration system includes various conventional refrigeration components, that is, a compressor 100, a heat-extraction heat exchanger 200, a first throttling element 300, and a heat-absorption heat exchanger 400 that are connected through pipelines sequentially. Moreover, the system further includes an ejector 500 for ejection refrigeration, having a main flow inlet 510 connected to the heat-extraction heat exchanger 200, a secondary flow inlet 520, and an ejector outlet 530; and a separator 600 for gas-liquid separation, having a separator inlet 610 connected to the ejector outlet 530, a separator liquid outlet 620 connected to the first throttling element 300, and a separator gas outlet 630 connected to a gas inlet 110 of the compressor 10. To facilitate switching of the ejector refrigeration system between different operating modes, this embodiment further includes a first flow path and a second flow path that can be switched, where the first flow path connects the heat-absorption heat exchanger 400 and the secondary flow inlet 520 of the ejector 500, and the second flow path connects the heat-absorption heat exchanger 400 and the gas inlet 110 of the compressor 100. In this deployment, on one hand, the current system only needs to alternatively turn on the first flow path or the second flow path to switch an operating mode, and the control logic is simpler and more reliable; on the other hand, when the system switches from the ejector mode to the standard mode, the secondary flow inlet of the ejector of the current system is turned off, while the main flow inlet and the outlet are turned on as usual, such that the ejector here can be used as another throttling element in the upstream of the first throttling element, and then the whole system is in a two-stage throttling state. Therefore, the pressure difference that should be originally born by the first throttling element in the standard mode is partially born by the ejector, and thus the pressure difference between two sides of the first throttling element is reduced correspondingly, which will ensure that the first throttling element does not have an overlarge pressure difference span between the two operating modes, thus simplifying model selection thereof and improving the operating reliability thereof.

To implement on/off control on the first flow path and the second flow path in the foregoing embodiment, a plurality of parts and manners may be adopted. For example, a three-way valve may be used to alternatively turn on one of the two flow paths; for another example, a separate switch valve may be used to control on/off of each flow path; for still another example, linked valves may be used to cooperatively control on/off of the two flow paths. Several examples will be made in the following to facilitate understanding.

As an example, the ejector refrigeration system includes a three-way valve 800, which is connected to the outlet of the heat-absorption heat exchanger 400, the secondary flow inlet 520 of the ejector 500, and the gas inlet 110 of the compressor 100 respectively, where, the ejector refrigeration system can turn on the first flow path or the second flow path alternatively by controlling switching of the three-way valve 800. For example, in the ejector mode, the three-way valve 800 turns on the first flow path, and the heat-absorption heat exchanger 400 is connected to the secondary flow inlet 520 of the ejector 500. Or, in the standard mode, the three-way valve 800 turns on the second flow path, and the heat-absorption heat exchanger 400 is connected to the gas inlet 110 of the compressor 100. At this point, switching of the operating mode of the whole system may be implemented by only controlling switching of one three-way valve, the control principle and control logic setting are extremely simple, and the system is highly reliable.

As another example, the ejector refrigeration system further includes a first solenoid valve disposed on the first flow path, and a second solenoid valve disposed on the second flow path, where, the ejector refrigeration system can turn on the first flow path or the second flow path alternatively by controlling on/off of the first solenoid valve and the second solenoid valve. For example, in the ejector mode, the first solenoid valve is turned on and the second solenoid valve is turned off, and the first flow path is thus turned on. Or, in the standard mode, the first solenoid valve is turned off and the second solenoid valve is turned on, and the second flow path is thus turned on. At this point, switching of the operating mode of the whole system may be implemented by only controlling on/off of two solenoid valves, the control principle and control logic setting are relatively simple, and the control over on/off of the flow paths is highly stable.

Moreover, to further improve the foregoing embodiments, other parts may be added or deployment of the existing parts may be optimized.

As an embodiment, the ejector refrigeration system further includes a second throttling element 900 disposed between the separator gas outlet 630 and the gas inlet 110 of the compressor 100, to ensure that refrigerant gas flowing out of the separator 600 and refrigerant gas flowing out of the second flow path have a balanced pressure difference. More specifically, the separator gas outlet 630 is connected to an intake port of the compressor 100 through the second flow path, where, the second throttling element 900 is disposed between the separator gas outlet 630 and the second flow path.

As another embodiment, the ejector 500 is an ejector 500 having an adjustable flow area of the main flow inlet 510. Therefore, the ejector can be served as a throttling element having a certain flow adjustment range.

Moreover, the system may further include a heat-regenerative heat exchanger 700 configured to provide heat exchange between a flow path, which is between the heat-extraction heat exchanger 200 and the ejector 500, and the second flow path, to improve the energy utilization.

To cooperate with use of the refrigeration system in the foregoing embodiment and an ejector refrigeration system having the same feature, a control method for an ejector refrigeration system is further provided here.

The control method includes: turning on a first flow path and turning off a second flow path in an ejector mode, where at this point, a passage connecting from the heat-absorption heat exchanger 400 to the secondary flow inlet 520 of the ejector 500 is turned on, and a passage connecting from the heat-absorption heat exchanger 400 to an intake port of the compressor 100 is turned off. At this point, ejection circulation can operate normally. It should be known that, although the passage connecting from the heat-absorption heat exchanger 400 to the intake port of the compressor 100 has been turned off, the heat-absorption heat exchanger 400 may still be connected to the intake port of the compressor 100 through the ejector 500 and the separator 600 sequentially. The control method further includes: turning on the second flow path and turning off the first flow path in a standard mode, where at this point, the passage connecting from the heat-absorption heat exchanger 400 to the intake port of the compressor 100 is turned on, and the passage connecting from the heat-absorption heat exchanger 400 to the secondary flow inlet 520 of the ejector 500 is turned off. At this point, the ejector 500 exists as a throttling element in a system loop, and bears a partial operating pressure difference for the first throttling element in the downstream thereof.

More specifically, in the ejector mode, a refrigerant flows through the compressor 100, the heat-extraction heat exchanger 200, the main flow inlet 510 of the ejector 500, the ejector outlet 530, and the separator inlet 610 sequentially; then, the refrigerant flowing out of the separator gas outlet 630 is throttled by the second throttling element 900, and then flows back to the compressor 100; the refrigerant flowing out of the separator liquid outlet 620 is throttled by the first throttling element 300, flows through the heat-absorption heat exchanger 400, and flows to the secondary flow inlet 520 of the ejector 500 through the first flow path. In the standard mode, the refrigerant flows through the compressor 100, the heat-extraction heat exchanger 200, the main flow inlet 510 of the ejector 500, the ejector outlet 530, and the separator inlet 610 sequentially; then, the refrigerant flowing out of the separator gas outlet 630 is throttled by the second throttling element 900 and flows back to the compressor 100; the refrigerant flowing out of the separator liquid outlet 620 is throttled by the first throttling element 300, flows through the heat-absorption heat exchanger 400, and flows back to the compressor 100 through the second flow path.

Specifically, a plurality of manners may be adopted to implement on/off control on the first flow path and the second flow path. For example, a three-way valve is used to alternatively turn on one of the two flow paths; for another example, a separate switch valve may be used to control on/off of each flow path; for still another example, linked valves may be used to cooperatively control on/off of the two flow paths, and so on. Several examples will be made in the following to facilitate understanding. As an example, on/off of the first flow path and the second flow path may be controlled at the same time by switching a three-way valve 800 disposed at an intersection of the first flow path and the second flow path. As another example, on/off of the first flow path and the second flow path may be controlled by a first solenoid valve disposed on the first flow path and a second solenoid valve disposed on second flow path, respectively.

An operating process of the system will be illustrated below with reference to the foregoing accompanying drawings as well as the described ejector refrigeration system and control method, where a mark "X" in FIG. 1 and FIG. 2 indicates that a corresponding flow path is in a non-off state; moreover, an arrow mark in the drawings indicates flow direction of the refrigerant in this operating mode.

Referring to FIG. 1, in the ejector mode, a high-pressure gas-phase refrigerant compressed by the compressor 100 flows into the heat-extraction heat exchanger 200 for condensation, the condensed high-pressure liquid-phase refrigerant flows into the ejector 500 through the main flow inlet 510 and is mixed with a low-pressure gas-phase refrigerant from the secondary flow inlet 520 to form a medium-pressure gas-liquid two-phase refrigerant, which is then ejected by the ejector outlet 530 into the separator 600 for gas-liquid separation. In the separator 600, on one hand, the liquid-phase refrigerant flows to the first throttling element 300 through the liquid outlet 620 for throttling, and enters the heat-absorption heat exchanger 400 for evaporation; subsequently, the low-pressure gas-phase refrigerant flows into the ejector 500 via the first flow path through the secondary flow inlet 520, and is mixed with the refrigerant from the main flow inlet 510 to form a medium-pressure gas-liquid two-phase refrigerant; on the other hand, after the gas-phase refrigerant flows, through the gas outlet 630 of the separator 600, to the second throttling element 900 for throttling, it joins the refrigerant in the second flow path and then flows back to the compressor 100 together, thereby completing the whole ejection refrigeration circulation.

Referring to FIG. 2, in the standard mode, a high-pressure gas-phase refrigerant compressed by the compressor 100 flows into the heat-extraction heat exchanger 200 for condensation, the condensed high-pressure liquid-phase refrigerant flows into the ejector 500 through the main flow inlet 510, is throttled for the first time in the ejector 500, and then is ejected to the separator 600 through the ejector outlet 530. In the separator 600, on one hand, the liquid-phase refrigerant flows, through the liquid outlet 620, to the first throttling element 300 for throttling, and enters the heat-absorption heat exchanger 400 for evaporation; subsequently, the low-pressure gas-phase refrigerant flows through the heat-regenerative heat exchanger 700 via the second flow path to perform regenerative heat exchange with a high-pressure liquid-phase refrigerant in the downstream of the heat-extraction heat exchanger 200, and finally flows back to the compressor 100; on the other hand, after the gas-phase refrigerant flows, through the gas outlet 630 of the separator 600, to the second throttling element 900 for throttling, it joins a refrigerant in the second flow path and then flows back to the compressor 100 together, thereby completing the whole standard refrigeration circulation.

The above examples mainly illustrate the ejector refrigeration system and the control method for the same according to the present invention. Merely some implementation manners of the present invention are described; however, those of ordinary skill in the art should understand that the present invention may be implemented in many other forms without deviating from the subject and scope thereof. Therefore, the examples and implementation manners shown are considered as illustrative rather than limitative, and the present invention may cover various modifications and replacements without departing from the spirit and scope of the present invention defined by the appended claims.

What is claimed is:

1. A control method for an ejector refrigeration system, the system comprising a compressor, a heat-extraction heat exchanger, an ejector, a separator having a gas outlet connected to an intake port of the compressor, a first throttling element, and a heat-absorption heat exchanger that are connected through pipelines, a first flow path connecting the heat-absorption heat exchanger and the ejector, and a second flow path connecting the heat-absorption heat exchanger and the compressor, wherein the method comprises:

turning on the first flow path and turning off the second flow path in an ejector mode, such that a passage connecting from the heat-absorption heat exchanger to a secondary flow inlet of the ejector is turned on, and a passage connecting from the heat-absorption heat exchanger to the intake port of the compressor is turned off; and turning on the second flow path and turning off the first flow path in a standard mode, such that the passage connecting from the heat-absorption heat exchanger to the intake port of the compressor is turned on, and the passage connecting from the heat-absorption heat exchanger to the secondary flow inlet of the ejector is turned off;

wherein turn-on and turn-off of the first flow path and the second flow path are controlled simultaneously by a three-way valve disposed at an intersection of the first flow path and the second flow path.

2. The control method according to claim 1, wherein turn-on and turn-off of the first flow path and the second flow path are controlled by a first solenoid valve disposed on the first flow path and a second solenoid valve disposed on the second flow path respectively.

3. The control method according to claim 1, wherein in the ejector mode, a refrigerant flows through the compressor, the heat-extraction heat exchanger, an ejector main flow inlet, an ejector outlet, and a separator inlet sequentially; then, the refrigerant flowing out of the separator gas outlet is throttled by a second throttling element and flows back to the compressor; the refrigerant flowing out of a separator liquid outlet is throttled by the first throttling element, flows through the heat-absorption heat exchanger, and flows to the secondary flow inlet of the ejector through the first flow path.

4. The control method according to claim 1, wherein in the standard mode, a refrigerant flows through the compressor, the heat-extraction heat exchanger, an ejector main flow inlet, an ejector outlet, and a separator inlet sequentially;

then, the refrigerant flowing out of the separator gas outlet is throttled by a second throttling element and flows back to the compressor; and the refrigerant flowing out of a separator liquid outlet is throttled by the first throttling element, flows through the heat-absorption heat exchanger, and flows back to the compressor through the second flow path.

5. An ejector refrigeration system, comprising:

a compressor, a heat-extraction heat exchanger, an ejector, a separator, a first throttling element, and a heat-absorption heat exchanger that are connected through pipelines, the ejector having a main flow inlet connected to the heat-extraction heat exchanger, and further having a secondary flow inlet and an ejector outlet;

the separator having a separator inlet connected to the ejector outlet, a separator liquid outlet connected to the first throttling element, and a separator gas outlet connected to a gas inlet of the compressor;

wherein turn-on and turn-off of a first flow path connecting the heat-absorption heat exchanger and the secondary flow inlet of the ejector and a second flow path connecting the heat-absorption heat exchanger and the gas inlet of the compressor are controllable;

a three-way valve connected to an outlet of the heat-absorption heat exchanger, the secondary flow inlet of the ejector, and the gas inlet of the compressor respectively, wherein the three-way valve is switched to alternatively turn on the first flow path or the second flow path.

6. The ejector refrigeration system according to claim 1, wherein in an ejector mode, the three-way valve turns on the first flow path, and the heat-absorption heat exchanger is connected to the secondary flow inlet of the ejector.

7. The ejector refrigeration system according to claim 1, wherein in a standard mode, the three-way valve turns on the second flow path, and the heat-absorption heat exchanger is connected to the gas inlet of the compressor.

8. The ejector refrigeration system according to claim 1, wherein the ejector is an ejector having an adjustable flow area of the main flow inlet.

9. The ejector refrigeration system according to claim 1, further comprising a heat-regenerative heat exchanger configured to provide heat exchange between a flow path, which is between the heat-extraction heat exchanger and the ejector, and the second flow path.

10. The ejector refrigeration system according to claim 1, further comprising a second throttling element disposed between the separator gas outlet and the gas inlet of the compressor.

11. The ejector refrigeration system according to claim 10, wherein the separator gas outlet is connected to an intake port of the compressor through the second flow path, wherein the second throttling element is disposed between the separator gas outlet and the second flow path.

12. The ejector refrigeration system according to claim 1, further comprising a first solenoid valve disposed on the first flow path, and a second solenoid valve disposed on the second flow path, wherein the first flow path or the second flow path can be turned on alternatively according to an on/off position of the first solenoid valve and the second solenoid valve.

13. The ejector refrigeration system according to claim 12, wherein in an ejector mode, the first solenoid valve is turned on and the second solenoid valve is turned off, and the first flow path is turned on.

14. The ejector refrigeration system according to claim 12, wherein in a standard mode, the first solenoid valve is turned off and the second solenoid valve is turned on, and the second flow path is turned on.

* * * * *